United States Patent [19]

Beck et al.

[11] 3,967,372

[45] July 6, 1976

[54] SHAVER WITH ADJUSTABLE LONG HAIR TRIMMER

[75] Inventors: William P. Beck, Westchester; Francis L. Carr, Downers Grove; Howard R. Chapin, Park Ridge; Gordon Bast, West Chicago, all of Ill.

[73] Assignee: Sunbeam Corporation, Chicago, Ill.

[22] Filed: Mar. 31, 1972

[21] Appl. No.: 239,998

[52] U.S. Cl. ..... 30/34.1; 30/43.1; 30/43.92

[51] Int. Cl.[2] ..... B26B 19/10; B26B 19/04

[58] Field of Search ..... 30/34.1, 43.1, 43.91, 30/43.92, 346.51

[56] References Cited

UNITED STATES PATENTS

| | | | |
|---|---|---|---|
| 2,574,317 | 11/1951 | Berg | 30/34.1 |
| 2,773,306 | 12/1956 | Ranson | 30/43.92 |
| 3,339,276 | 9/1967 | Tolmie | 30/43.92 X |
| 3,365,796 | 1/1968 | Tolmie | 30/43.92 |
| 3,389,323 | 6/1968 | Jepson | 30/43.92 UX |
| 3,589,005 | 6/1971 | Fischer | 30/34.1 |

FOREIGN PATENTS OR APPLICATIONS

| | | | |
|---|---|---|---|
| 1,243,563 | 6/1967 | Germany | 30/34.1 |

*Primary Examiner*—Al Lawrence Smith
*Assistant Examiner*—Gary L. Smith
*Attorney, Agent, or Firm*—George R. Clark; Neil M. Rose; John S. Pacocha

[57] ABSTRACT

An electric shaver having two spaced shaving heads with a long hair clipper or trimmer positioned therebetween with the trimmer being adjustable to a retracted position or to an extended position in which it is spaced from the shaving heads and is adaptable to trimming sideburns, moustaches and the like. The trimmer is slidably supported on a head frame which is detachably mounted with respect to a motor enclosing housing. The trimmer is spring biased into engagement with cam means carried by the housing and adapted to position the trimmer at various heights with respect to the shaving heads. The shaving heads include foil combs carried by the head frame and spring biased against cutters which are mounted on the housing and supported for reciprocation on friction reducing ball rollers. The motor drives the trimmer and shaving cutters by means of a double eccentric carried by the motor shaft and a pair of coaxially pivoted levers which oscillate in an out-of-phase relationship.

17 Claims, 23 Drawing Figures

Fig. 16
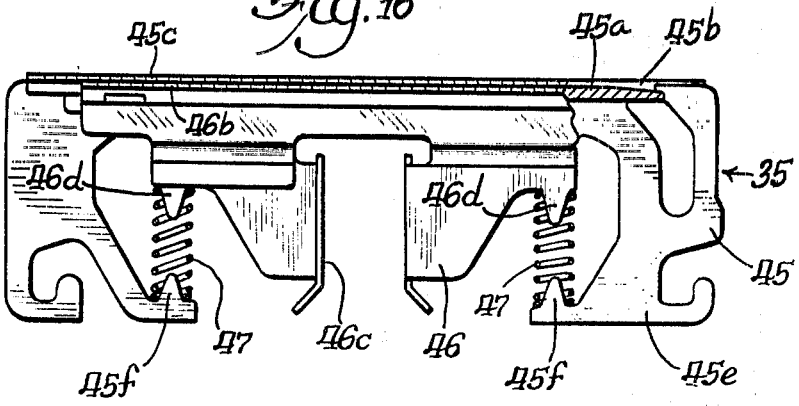
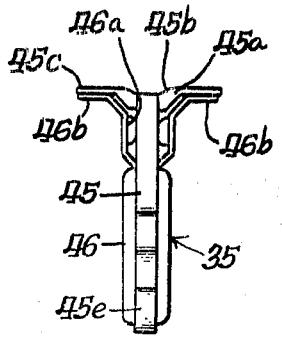
Fig. 17.
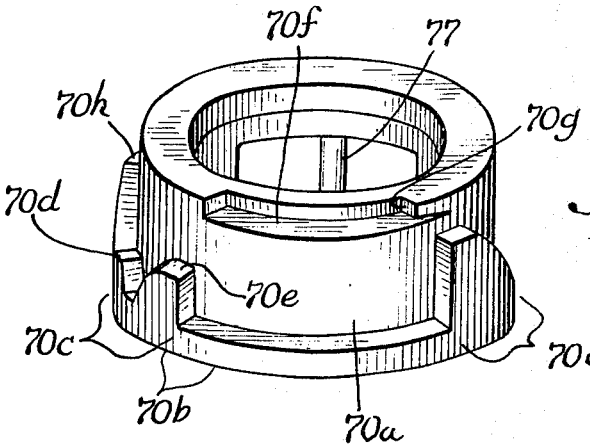
Fig. 23.
Fig. 18
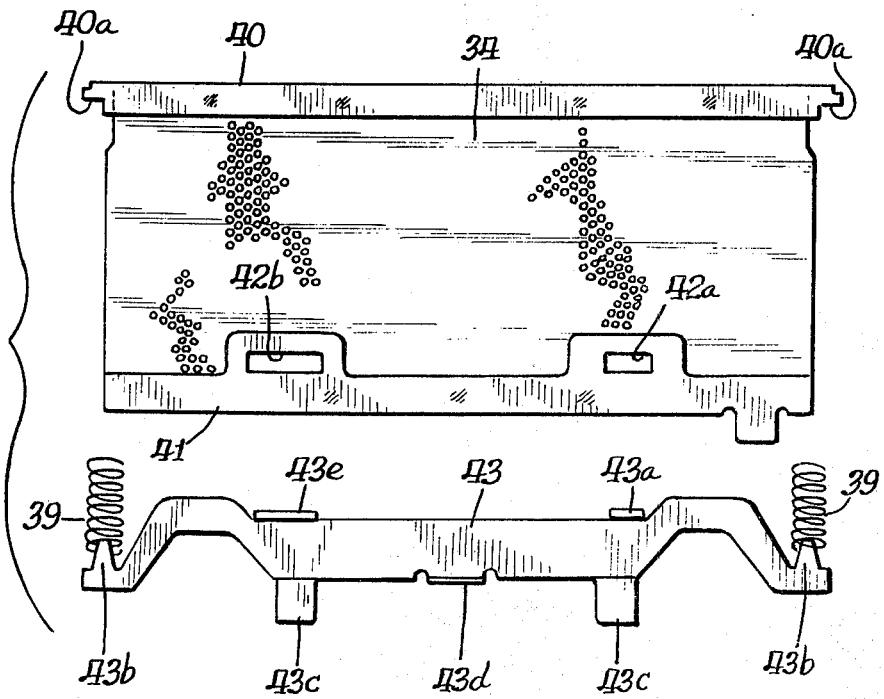

SHAVER WITH ADJUSTABLE LONG HAIR TRIMMER

BACKGROUND OF THE INVENTION

The field of electric dry shaving has progressed significantly in the last 40 years since such shavers were first made available commercially in the United States. During this period various basic shaving principles have been developed and perfected to a high degree from the standpoint of quality and uniformity of the product. It is well recognized by those skilled in the art that the satisfactory performance of an electric shaver depends to a large extent on whether or not it can be manufactured to the required close tolerances in order that a close and comfortable shave may be obtained. As the quality of shavers has improved, however, it has been noted that there are some inherent limitations in many of the basic shaving approaches. The recognition of these limitations has caused shaver manufacturers to modify their designs so as to utilize more than one general shaving approach in the design of their shaving heads. Explaining this situation in more specific terms, we note that it is possible to obtain the closest and most comfortable shave by utilizing a shaver having a thin, perforated, fixed shearing member or comb which is used in combination with either a reciprocating or oscillating cutter system. Because the thickness of the comb and the size of the perforations may be controlled very accurately, it is possible with this type of system to produce a shaving head which will give a very close shave with a minimum amount of skin irritation.

The perforated comb is generally less satisfactory, however, in cutting long hairs or trimming along the hair line or around the moustache since it is difficult to position a long hair properly for entrance into one of the perforations. To solve this problem various approaches such as placing slots in the comb or adding auxiliary trimmers have been attempted. While the comb slots are reasonably effective on long facial hairs, they complicate the manufacturing of the perforated comb and are relatively ineffective in trimming sideburns, moustaches and the like. The auxiliary trimmer which is normally positioned at the side or at one end of the shaving heads is satisfactory for trimming sideburns and moustaches but is inconvenient and relatively unsatisfactory as far as cutting long facial hairs during the shaving process concerned. In other words, if you miss a facial hair with the shaving head, it is necessary to move the trimmer into position to cut that specific hair. As a consequence the shavers utilizing the combination shaving head with an auxiliary trimmer have been found to be relatively unsatisfactory from the standpoint of picking up long hairs during the shaving operation.

The ultimate goal of dry shaver designers, manufacturers and users is the "one pass" electric shaver which would shave satisfactorily with one traverse across the skin in much the same way as a conventional blade type shaver will perform. To accomplish this "single pass" shaving, it is necessary to include both the shaving head and the long hair trimmer positioned so that both operate during the single pass across the face.

There have been a number of examples of multi-headed shavers which include heads adapted for shaving positioned in close proximity to heads adapted for trimming. The patent to Kleinman, U.S. Pat. No. 2,529,169 and Brauss U.S. Pat. No. 2,917,824 are noted in this regard. The patent to Berg, U.S. Pat. No. 2,574,317 shows an arrangement in which the center head of the shaver is movable for trimming purposes. The center head in U.S. Pat. No. 2,574,317 is described as having "an adjustable center head movable relative to and outwardly from [the ] side heads "and having" comparatively wide slots for cutting long hairs." None of these patents, however, provide a satisfactory solution to the problem of shaving and trimming simultaneously with a shaver and also the making available of the trimmer for use in trimming sideburns and moustaches.

SUMMARY OF THE INVENTION

The invention involves a shaving head assembly which is equipped with two spaced shaving heads having perforated foil combs and having a long hair trimmer adjustably mounted between the two shaving heads. The trimmer and shaving heads are supported at least in part on a head frame which is detachably mounted on a motor enclosing shaver housing. The trimmer is slidably supported in the head frame and means are included to spring bias the trimmer toward the housing so that it may be engaged by cam means for positioning the trimmer at various levels with respect to the adjacent shaving heads.

The shaver housing supports a manually operable control means which operates the cam means rotating it to various positions to establish the location of the trimmer. In addition, the cam means is coupled to a latch which removably connects the head frame to the shaver housing.

The shaver housing is arranged with a lengthwise extending handle portion which encloses the motor for driving the trimmer and the shaving heads. The head assembly is mounted on one end of the housing with the face thereof inclined so as to make it more convenient to grasp the handle of the shaver and apply the head against the face of the user. This angular disposition of the shaving head with respect to the motor complicates the manner of drivingly interconnecting the motor and the shaving heads and the trimmer. To accomplish this function, a pair of somewhat L-shaped drive levers mounted on a common axis are employed. The lower ends of the drive levers engage separate eccentrics connected to the motor shaft so that the shaving heads may be made to oscillate in an out-of-phase relationship. The trimmer is driven by a lateral projection formed on one of the shaving head drive levers.

It is an object of the present invention to provide an improved electric dry shaver which is capable of shaving and trimming long hair in a single pass across the face of the user.

It is a further object of the present invention to provide an improved electric dry shaver having, in addition to shaving heads, a long hair clipper which is operable in either combination with the shaving heads or alternatively is movable to a position spaced from the shaving heads for the purpose of trimming sideburns, moustaches and the like.

It is still another object of the present invention to provide an improved electric dry shaver having a detachable head frame which supports a trimmer biased into engagement with cam means on the shaver housing.

It is another object of the present invention to provide a shaver housing having a head assembly mounted on one end thereof with the head assembly being angled with respect to the axis of the elongated handle and having a pair of overlapping drive levers which interconnect the motor with the shaving heads to drive the cutters in an out-of-phase relationship.

BRIEF DESCRIPTION OF THE DRAWINGS

FIG. 12 is similar to FIG. 11 but shows the cam and trimmer in the position for trimming sideburns, moustaches and the like;

FIG. 16 is a side elevational view of the trimmer with portions thereof cut away;

FIG. 17 is an end elevational view of the trimmer of FIG. 16;

FIG. 18 is an exploded view of one of the shaver combs and its supporting plate;

FIG. 23 is a perspective view of the clipper positioning cam.

DESCRIPTION OF THE PREFERRED EMBODIMENT

Figure 1:
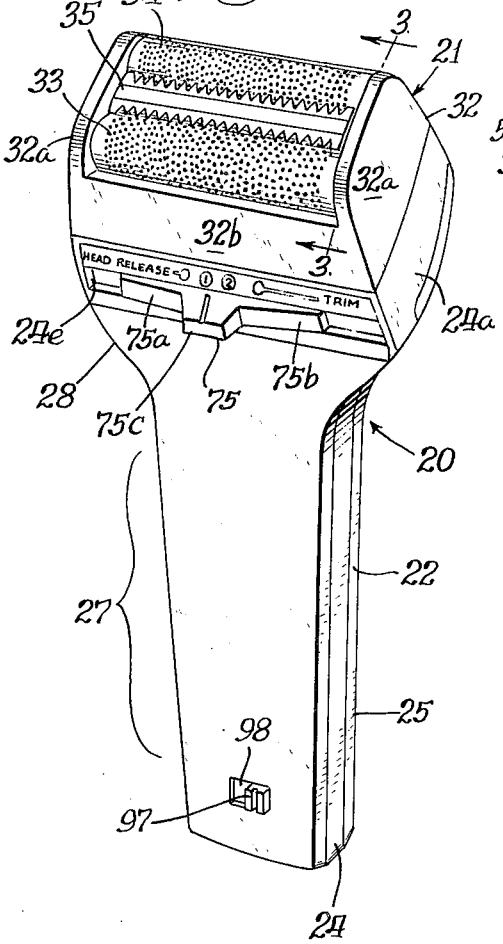
FIG. 1 is a perspective view of an electric dry shaver embodying our invention.

Referring now to the drawings, there is shown an electric dry shaver designated generally by reference numeral 20. The shaver 20 includes a head assembly 21 which is mounted on one end of a generally elongated housing 22. As is evident from FIGS. 1 and 2, the head assembly 21 is inclined at a substantial angle to the elongated axis of the housing 22. When the shaver is gripped in the normal manner, the head is inclined so it may be more naturally and easily applied to the face and neck area of the user.

Figure 2:
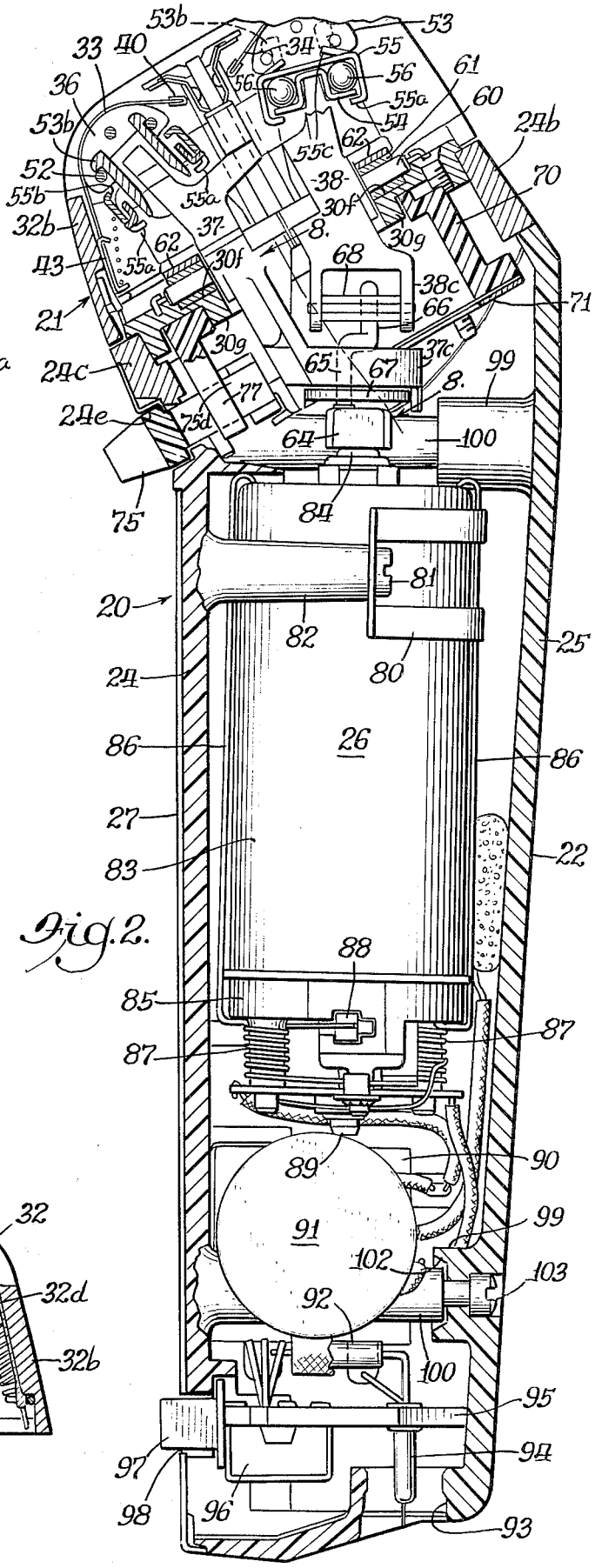
FIG. 2 is a side elevational view of the shaver of FIG. 1 with portions of the housing cut away to expose the internal mechanism thereof.

The housing 22 is made up of a front supporting frame or housing member 24 which cooperates with a rear housing member 25 to form an elongated enclosure within which a motor 26 is received. The two housing members 24 and 25 fit together to form a handle or gripping portion 27 which is on the order of 1½ inches thick and 1½ inches wide and rounded slightly so that it may be readily gripped in the hand of the user. At its uppermost end as shown in FIG. 1, the housing 22 is flared out at 28 in order to provide a mounting base for the head assembly 21. In the area of the flared-out portion 28 the front housing or frame member 24 extends rearwardly with walls 24*a*, one of which is shown in FIG. 1, and a transverse or rear wall 24*b* as shown in FIG. 2. Extending across the front of the housing or frame member 24 opposite the rear wall 24*b* is an angled front wall 24*c* as is best shown in FIG. 2. The walls 24*a*, *b* and *c* define a rectangular opening in the top of the housing 22 which is closed by the head supporting chassis 30 which is best shown in FIGS. 10, 19, 20, 21 and 22. The chassis 30 is of generally rectangular configuration having a central opening 30*a* through which the drive between the motor 26 and the head assembly 21 extends. The chassis 30 serves the dual purpose of closing the top opening in the housing 22 and also in providing a mounting for the various other parts of the head assembly 21.

The head assembly 21 consists of an open, generally rectangular head frame 32 which supports the perforated combs 33, 34 and a centrally disposed trimmer or long hair clipper 35. The head frame 32 is formed with end walls 32*a* and lengthwise extending side walls 32*b* which together form a frame having a large central opening within which the perforated combs 33, 34 and the trimmer 35 are mounted.

Figure 3:
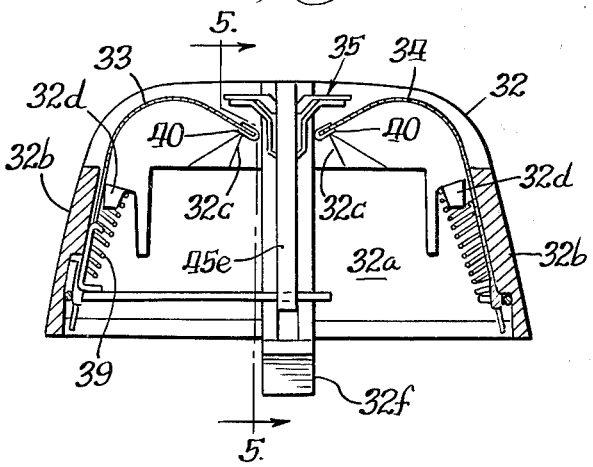
FIG. 3 is an enlarged sectional view of the head assembly taken substantially on line 3—3 of FIG. 1.

Positioned immediately below the perforated combs 33, 34 and supported on the chassis 30 are cutters 36 which are mounted for reciprocation as they are driven by the drive levers 37 and 38. The cutters 36 are mounted on the chassis 30 so that they may be reciprocated a short distance while in shearing engagement with the combs 33, 34. In order to insure good shearing engagement between the combs 33, 34 and the cutters 36, the outer edges of the combs 33 and 34 are biased downwardly by means of springs 39 as shown in FIG. 3. Each of the combs are formed of a thin, flexible steel material which is on the order of 0.002 inches thick and is formed with perforations which are on the order of 0.018 inches in diameter. Secured to the inner edges of each of these combs is a reinforcing strip 40 which has its outer ends formed of reduced width as shown at 40*a* in FIG. 7 to form trunnions which pivotally support the combs along their inner edges. The trunnions 40*a* are received in downwardly facing recesses 32*c* (FIG. 3) cast integrally with the head frame 32. This pivotal supporting of the inner edges of the perforated combs 33, 34 permits the combs to adjust and to better conform to the curvature of the cutters 36.

Figure 5:
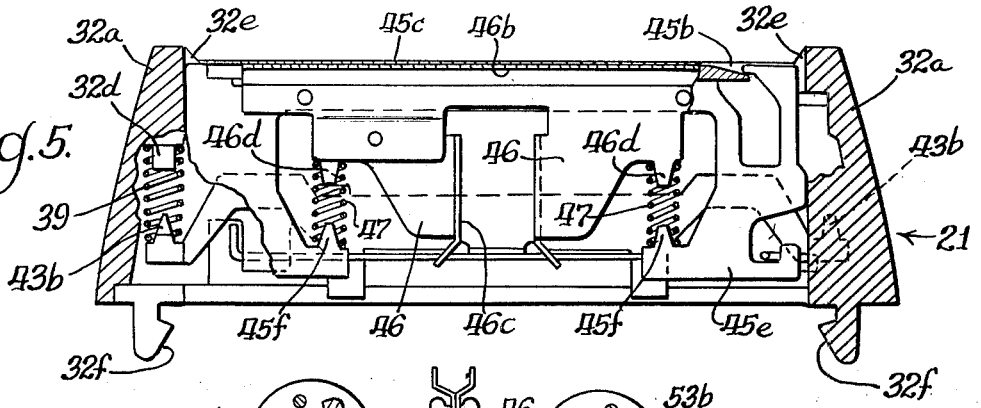
FIG. 5 is an enlarged sectional view of the head assembly taken substantially on line 5—5 of FIG. 3.

The outer edges of the combs 33, 34 are formed with reinforcing strips 41 which are formed with mounting slots 42*a* and 42*b*, the latter being larger in order that the comb may be inserted only in one position with the desired side facing outwardly. The strips 40 and 41 are formed of much heavier material than the foil combs 33 and 34 and are folded around the edges of the comb and welded to provide bars by means of which the foil combs may be tensioned across the cutters 36. In order to bias the outer edges of the combs 33 and 34 downwardly with respect to the head frame 32, there is provided an elongated plate 43 which, as shown in the upper portion of FIG. 7 and in FIG. 18, includes projections 43*a* and 43*e*, the latter being larger in order that the comb may only be assembled in one way as discussed previously for insertion into the comb mounting slots 42*a* and 42*b*. The projections 43*a* and 43*e* insert into the slots 42*a* and 42*b* in the strip 41. The outer ends of the plate 43 are formed with upwardly facing projections 43*b* as shown in FIGS. 5 and 18 to receive the lower ends of the biasing springs 39. The upper ends of the springs 39 are received on the integrally formed projections 32d formed in head frame 32, (FIGS. 3 and 5). Thus as the springs 39 act downwardly against the outer ends of the plate 43, the hooks 43*a* and 43*e* tend to draw the perforated comb downwardly into conforming engagement with the cutter 36. Also provided on plate 43 are tabs 43*c* which tend to guide the plate in its sliding movement and a stop projection 43*d* which limits the downward movement of the plate 43.

Mounted on the head frame 32 between the two perforated combs is the trimmer 35 which consists of a somewhat T-shaped stationary cutter 45 and a movable cutter 46. The stationary cutter 45 includes an upper plate portion 45*a* which has a central channel 45*b* and rows of outwardly facing teeth 45*c* on the opposite edges thereof. Connected to the plate portion 45*a* and extended downwardly therefrom is a mounting shank 45*e*. The central portion of the shank 45*e* is cut away as best shown in FIG. 5 and 16 to provide space for the reciprocating cutter 46.

Figure 13:
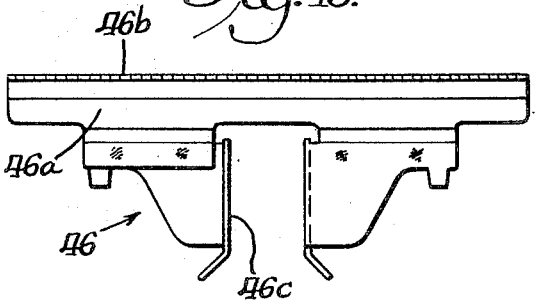
FIG. 13 is a side view of the movable shearing member or cutter used in connection with the trimmer.

The cutter 46 has a central channel portion 46*a* which is received over and guided by a lengthwise extending portion of the stationary cutter 45. The cutter 46 also includes rows of outwardly extending teeth 46*b* which are biased into shearing engagement with the underside of the plate portion 45*a*. The cutter 46 is formed by two identical stamped metal plates which are welded together to form the complete cutter 46. The spaced portions of the cutter form a drive arm receiving recess 46*c* as is best shown in FIGS. 13 and 16. In order to bias the cutter 46 into engagement with the stationary shearing member 45, helical springs 47 are mounted as shown in FIG. 5 with their lower ends received on projections 45*f* and their upper ends on projections 46*d* formed on the cutter 46. The assembly made up of the stationary shearing member 45, the cutter 46 and the springs 47 is movably mounted on the head frame 32 by means of the member 45 being received at its outer ends within vertically extending slots or channels 32*e* (FIG. 7) formed in the end walls 32*a* of the head frame 32.

Figure 7:
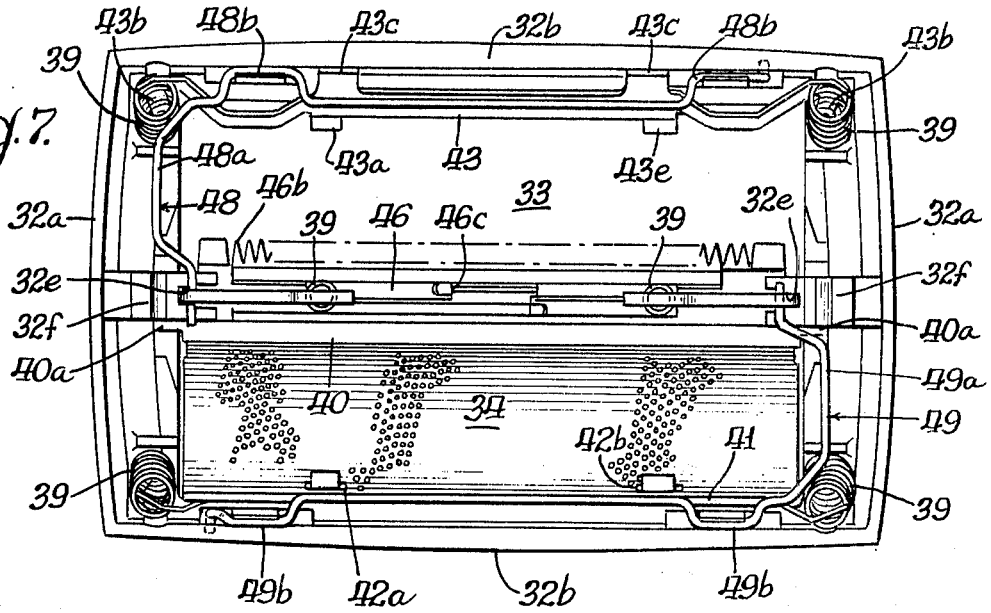
FIG. 7 is a bottom plan view of the head frame shown in FIG. 3.

For a purpose which will be explained more completely below, the trimmer 35 is biased downwardly by means of a pair of L-shaped springs 48 and 49 which are best shown in FIG. 7. Both of the springs 48 and 49 have mounting portions which extend lengthwise along the side walls 32*b* and connecting portions 48*a* and 49*a* which extend inwardly into hoooked engagement with the shank portion 45*e* of the stationary shearing member. The springs 48 and 49 have laterally offset portions 48*b* and 49*b* which are received under deformed portions of the head frame 32 to thereby pivotally connect the springs 48 and 49 to the head frame 32 at these offset portions. The portions of the springs 48 and 49 extending between these offset portions overlie the tabs 43*c* and serve to retain and guide the plate 43. In addition, the step 43*d* on the plate 43 engages the springs 48 or 49 and thereby limits downward movement of the plates 43 under the biasing force of springs 39. In the normal position of the springs 48 and 49 engaged with the shank portion 45*e* of the trimmer 35, the springs 48 and 49 bias the trimmer 35 downwardly to its lowermost position as shown in FIG. 3. As will be more completely explained below, the trimmer 35 is movable also to the alternative position shown in FIGS. 11 and 12 for performing various functions.

The cutters 36 which were referred to briefly above, consist of a plurality of cutter blades 51 which are mounted and supported in parallel spaced relation by lengthwise extending rods 52. Centrally disposed on the cutters 36 are drive blocks 53, which are shown in section in FIGS. 2 and 6. The drive blocks include projections 53*b* which snap into engagement with the support rods 52 and provide a pocket or recess 53*a* into which the upper ends of the drive levers 37 and 38 extend to transmit motion from the drive levers to the cutters 36.

Figure 8:
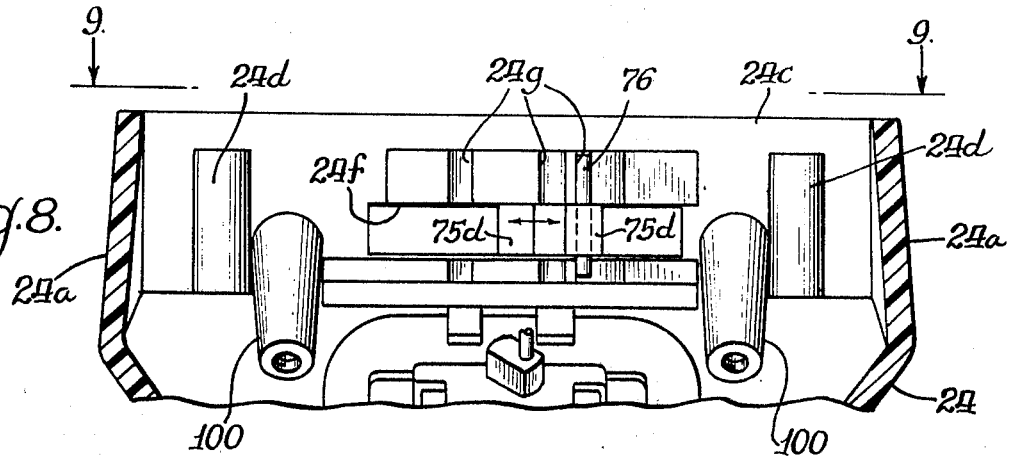
FIG. 8 is an enlarged fragmentary sectional view taken substantially along line 8—8 of FIG. 2 with the head supporting chassis, the drive levers and the cam means removed to expose the cam operating slide.
Figure 9:
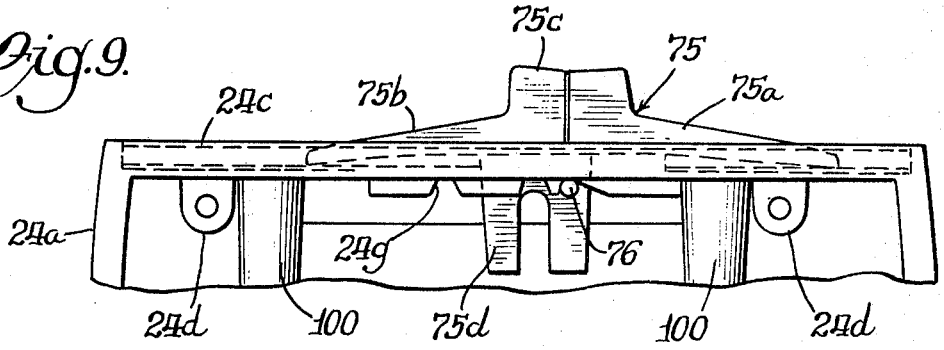
FIG. 9 is an enlarged fragmentary view taken on line 9—9 of FIG. 8.

The cutters 36 are supported on the housing 22 by means of the head supporting chassis 30. The chassis 30 comprises a rather intricate molded part which is best shown in FIGS. 10, 19, 20, 21 and 22. As was mentioned above, the chassis 30 has a central opening 30*a* through which the drive levers 37 and 38 extend. The opening 30*a* is in the center of a flat plate-like portion 30*b* which has four holes 30*c* in its corners to receive assembly screws which secure the chassis 30 to the housing frame member 24. These assembly screws extend into integrally molded bosses 24*d* which are best shown in FIGS. 8 and 9. Located immediately inwardly of the holes 30*c* are upwardly projecting posts 30*d* which are arranged in pairs to receive and support the ends of a cutter support plate 54 which is shown in elevation in FIGS. 19 and 20 and shown in section in FIG. 2 and in perspective in FIG. 22. The outer ends of the elongated support plate 54 are formed with downwardly extending tabs 54*a* which are press fit into openings 30*e* molded in the upper ends of the cutter support posts 30*d*. The assembly tabs 54*a* are provided with barbed projections which dig into the plastic walls defining the openings 30*e* and lock the cutter support plates 54 in firm assembly with the chassis 30.

Overlying each of the support plates 54 and secured to the cutters 36 by means of engagement with the drive block 53 is a channel-shaped member 55 which serves as a top bearing race to support and enclose four ball bearings 56 in connection with each of the cutters 36. As is best shown in the sectional view of FIG. 2 and in FIGS. 19 and 20, the top race 55 is an elongated channel-shaped member which overlies and surrounds the cutter support plate 54 which provides the lower race for the ball bearings 56. The top race 55 is formed with four inwardly extending tabs 55*a* which extend beneath the cutter support plate 54 and retain the support plate 54, the top race 55 and the ball bearings 56 in assembled relationship. As thus assembled, the tabs 55*a* permit reciprocating movement of the member 55 with respect to the cutter support plate 54. The center portion of the member 55 is formed with an opening 55*b* (FIG. 2) through which the drive block 53 extends. On the edges of this opening 55*b*, there are formed a number of projections 55*c* which interlock with the drive block 53 to connect the cutter 36, the drive block 53 and the member 55 is a rigid assembly. As the projections 53*b* on the drive block 53 snaps into engagement with the rods 52 on the cutter 36, the drive block 53 clamps the member 55 against the bottom of the cutter blades 51 thereby providing a firm assembly which is urged downwardly against the bearing balls 56 as a consequence of the downward force exerted by the perforated combs 33 or 34.

In order to reduce the power necessary to drive the reciprocating cutters 36, there are provided a pair of springs 58 which engage each of the drive blocks 53 at their inner ends and are supported on their outer ends by vertically extending wall portions 54*b* formed on the support plate 54. Pockets are provided in the drive blocks 53 to receive the inner ends of the springs 58 and conical projections 54*c* (FIG. 19) formed on the walls 54*b* support the outer ends of the springs 58. The springs are tuned so that they absorb energy and return it to the system as the cutters 36 are reciprocated back and forth. This flow of energy to and from the springs 58 reduce the overall power required to drive the cutters 36.

Figure 4:
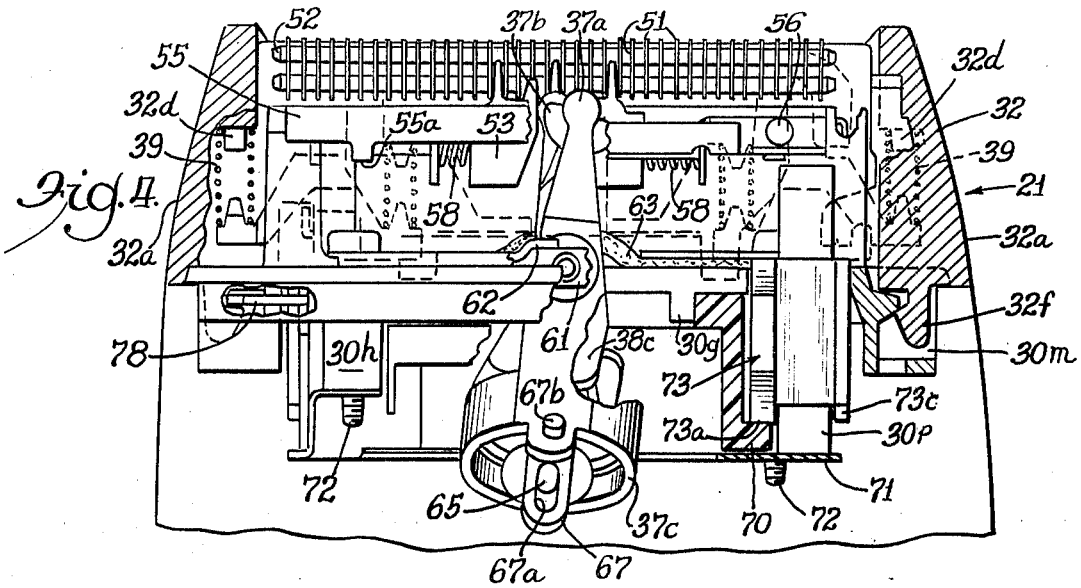
FIG. 4 is an enlarged fragmentary front elevational view of the shaver of FIG. 1 with portions of the casing, head frame and combs cut away for illustrative purposes.
Figure 6:
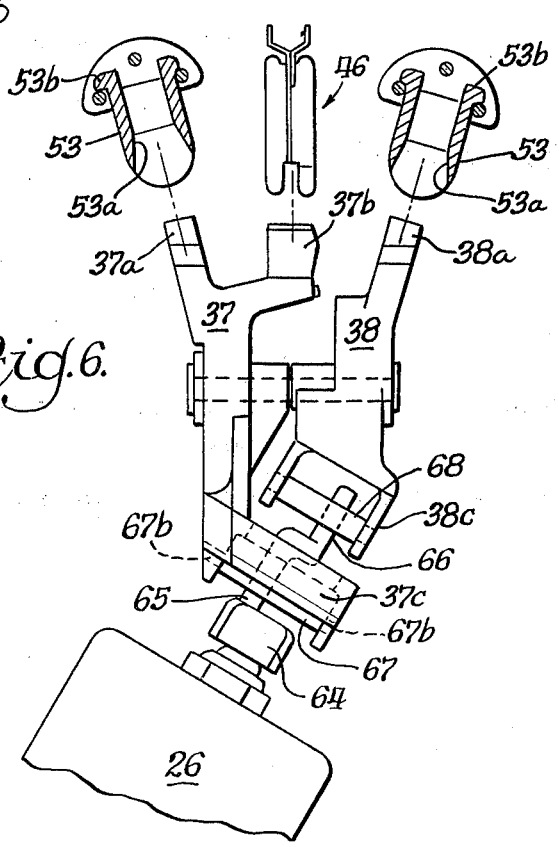
FIG. 6 is an exploded view of the mechanism which drivingly interconnects the motor with the shaver cutters and the trimmer of the shaver of FIG. 1.

The drive arms 37 and 38 are shown most clearly in FIGS. 2, 4 and 6. As was stated above, the drive arms extend through the opening 30a formed in the chassis 30. In addition, the chassis 30 serves as a support for an axle 60 on which both of the drive levers 37 and 38 are pivoted. The axle or shaft 60 is provided with oval, plastic bearing members 61 (FIG. 4) which journal the opposite ends of the shaft 60. The bearing members 61 are received in channel-shaped recesses 30*f* formed at either end of the central opening 30*a*. The bearing members 30 are received in these recesses and are retained in position by bearing retaining plates 62. The bearing retaining plates 62 merely extend across the bearing member 61 and retain them in the recesses 30*f*. The retaining plates 62 perform a secondary function of retaining a foam pad 63 which extends between the drive levers 37 and 38 and tends to prevent hair clippings from passing through the opening 30*a* into the housing in which the motor is enclosed. Although the drive arms 37 and 38 are shaped differently in their overall form, both of them include at their upper ends rounded driving portions 37*a* and 38*a* to provide a low frictional engagement between the drive arms and the drive blocks 53. As is best shown in FIG. 6, the drive blocks 53 include upwardly extending recesses 53*a* into which the drive ends 37*a* and 38*a* extend.

The innermost drive lever 37 which is positioned adjacent to the frame member 24 has a bifurcated upper portion which includes, in addition to the drive end 37*a*, a trimmer drive end 37*b*. The drive end 37*b* is rounded in similar fashion to the drive ends 37*a* and 38*a* and is adapted to extend into the drive opening 46*c* formed in the movable cutter 46 of the trimmer 35. As a consequence, the cutter 46 of the trimmer 35 reciprocates in synchronism and in phase with the cutter 36 which is driven by the drive lever 37. It should be noted that the drive opening 46*c* and the cutter 46 is of substantial length so that the trimmer drive end 37*b* remains in engagement with the cutter 46 throughout the substantial distance through which the trimmer 35 may be adjusted as will be explained in greater detail below.

The motor 26 has secured to its output shaft a crank member 64 which includes two eccentric portions 65 and 66. The eccentric portions 65 and 66 serve as crank pins which are located offset from the axis of the motor 26 but which extend parallel thereto. The eccentric portions 65 and 66 are diametrically positioned with respect to the motor axis and consequently drive the cutters 36 in opposite directions at any given time, or as one might characterize, 180° out of phase.

In order to drivingly connect the eccentric portions 65 and 66 with the lower ends of the drive levers 37 and 38, there are provided pivotally mounted yoke members 67 and 68. The yoke members 67 and 68 each have an elongated slot for receiving one of the eccentric portions 65 or 66. In FIG. 4 there is shown the yoke members 67 having a slot 67*a* in which the eccentric portion 65 is received. Each end of the yoke 67 is formed with an integrally molded projection 67*b* which is received in an opening formed in the side wall of circular end portion 37*c* of the drive lever 37. Similarly, the yoke member 68 is provided with integrally formed projections which journal with pivotal movement with respect to the bifurcated end portion 38*c* of the drive lever. It will be noted from FIG. 6 that the configuration of the drive levers 37 and 38 is such that they may both be mounted for oscillation on a common shaft 60 while at the same time driven by a common crank member 64 while oscillating in an out-of-phase relationship.

Figure 21:
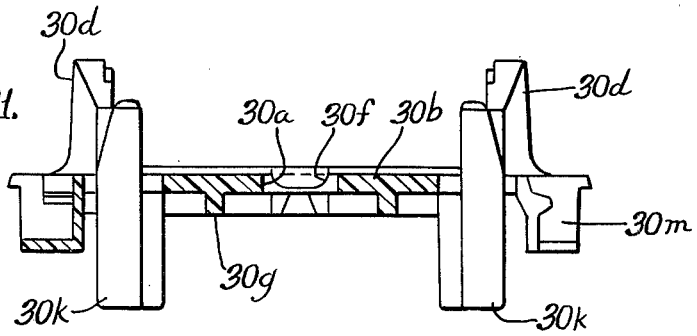
FIG. 21 is a sectional view of the head supporting chassis taken on line 21—21 of FIG. 20.

For the purpose of raising and lowering the trimmer 35, there is mounted on the bottom of the chassis 30 a cylindrical cam 70 which is shown in FIGS. 4, 11, 12 and 23. The cam 70 is positioned beneath the chassis 30 and rotates about a vertical axis which is centrally disposed with respect to the chassis 30. To guide the cam 70 in its rotary movement and position it on the bottom of the chassis 30, there is provided an angular rib 30*g* which extends downwardly from the bottom of the plate-like portion 30*b* as is best shown in FIGS. 4 and 21. The cam 70 is retained in position against the bottom of the chassis 30 by means of a retaining plate 71 which is secured to the lower ends of downwardly extending bosses 30*h* through which the assembly screws 72 extend into threaded engagement with the retaining plate 71. The screws 72 also extend through the bearing retaining plates 62 to hold them assembled against the upper surface of the chassis 30. The retaining plate 71 is of somewhat C-shaped configuration so that it provides clearance for the drive levers 37 and 38 which interconnect the motor 26 and the cutters 36. As may be seen from FIGS. 11, 12 and 23, the cam 70 is formed with a cylindrical central portion 70*a* which is surrounded by an annular portion 70*b*. The annular portion 70*b* is formed with two identical stepped portions 70*c* as indicated in FIG. 23.

Figure 11:
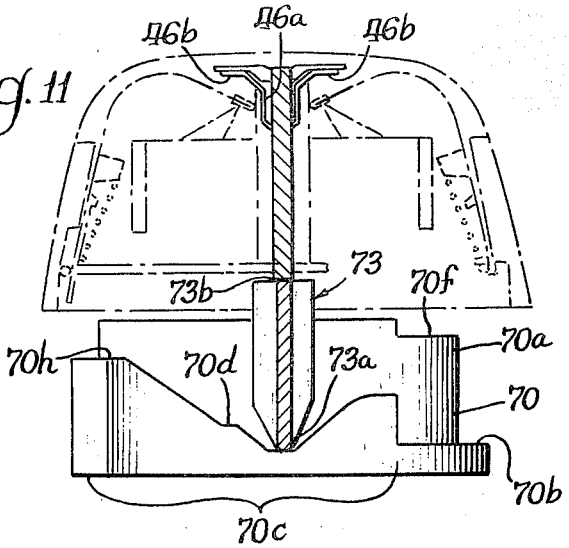
FIG. 11 is a somewhat schematic view showing the cam for operating the trimmer in full lines and the trimmer in section and the remaining portions of the head assembly in dashed lines to show the relationship between the cam, the trimmer and the head in the shaving position.
Figure 14:
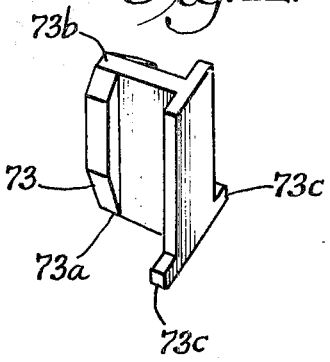
FIG. 14 is a perspective view of the cam follower which is operated upon by the rotatable cam to position the trimmer.
Figure 12:
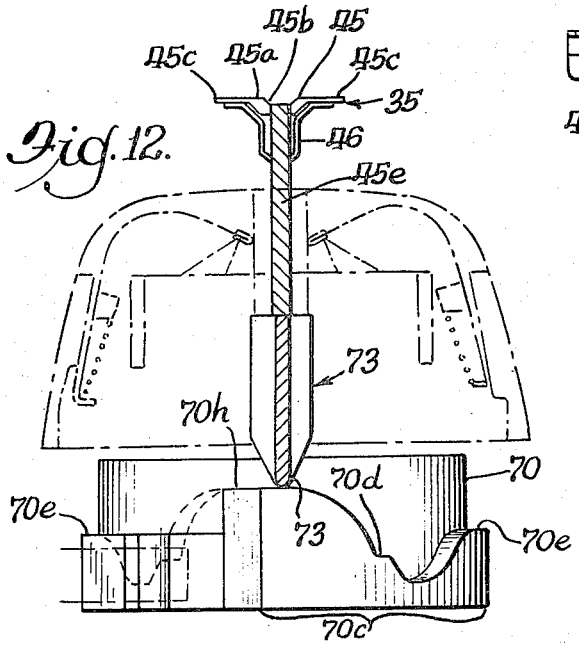
Figure 15:
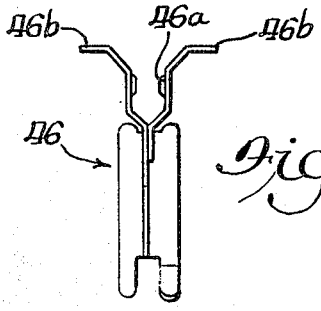
FIG. 15 is an end view of the cutter shown in FIG. 13.
Figure 19:
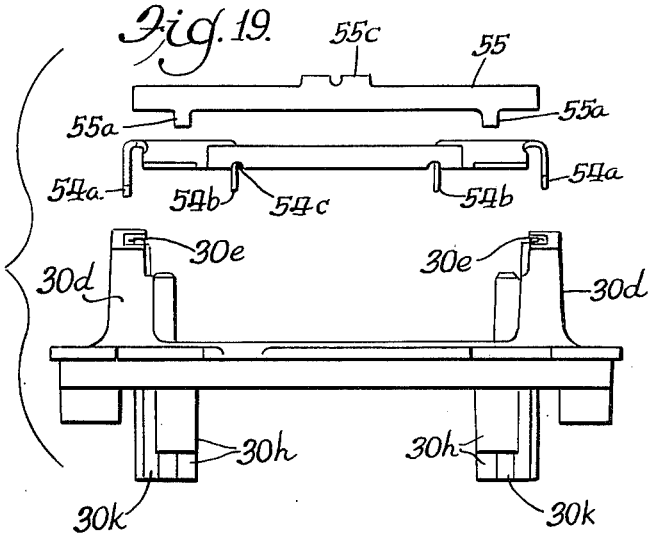
FIG. 19 is a front elevational view of the head supporting chassis taken on line 19—19 of FIG. 10 and showing the cutter supporting parts in exploded relationship therewith.
Figure 20:
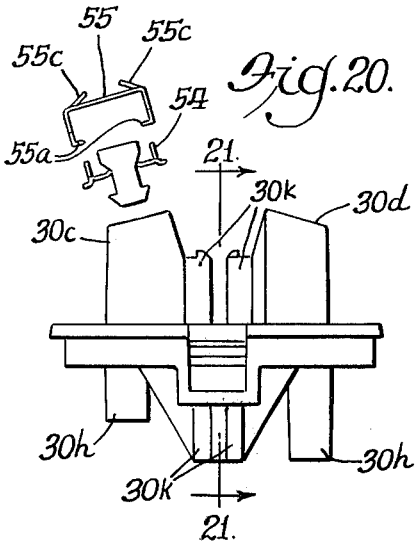
FIG. 20 is an end elevational view of the head supporting chassis of FIG. 19 again with the cutter supporting parts shown in exploded relation therewith.
Figure 22:
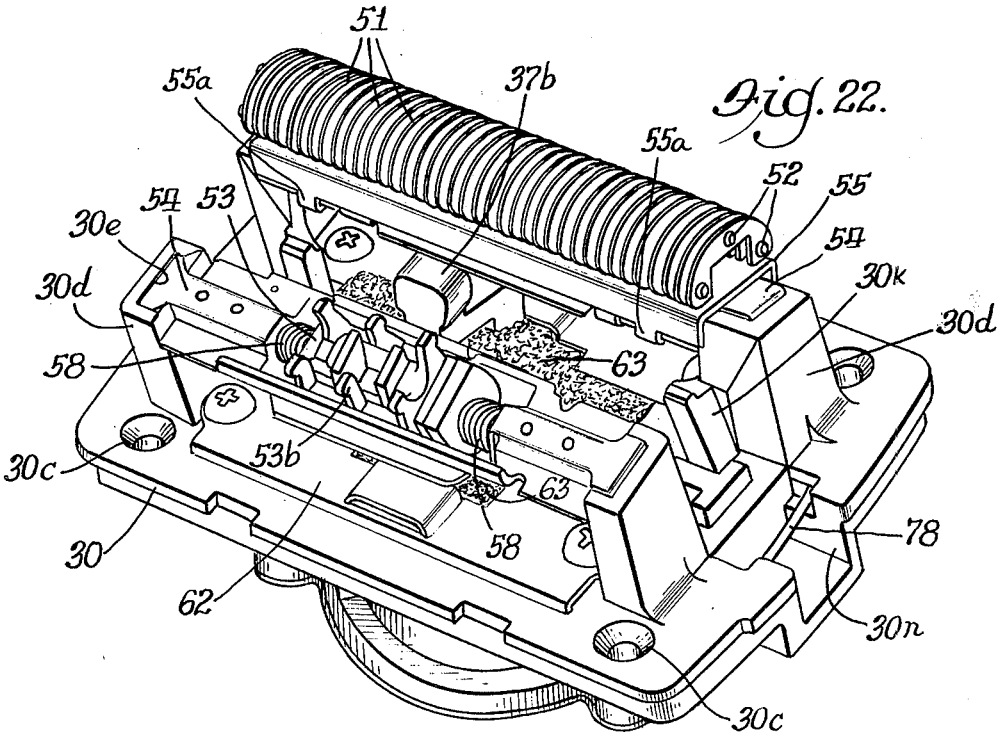
FIG. 22 is a perspective view of head supporting chassis with the head frame and one of the cutters removed therefrom.

Engaging the annular stepped portions 70*c* at diametrically opposed positions are cam followers 73 which are slidably received in openings 30*j* formed in the chassis 30. One of the cam followers 73 is shown in perspective in FIG. 14. The chassis 30 is formed with H-shaped openings 30*j* to receive and guide the cam followers for vertical sliding movement and there are vertically extending, spaced ribs 30*k* which extend above and below the plate-like portion 30*b* of the chassis 30 which is best shown in FIGS. 20, 21 and 22. The lower inner ends of each of the cam followers 73 is formed with a narrow, rounded end portion 73*a* which rides along the annular stepped portion 70*c* of the cam 70 as illustrated in FIGS. 11 and 12. The cam follower 73 is formed with a generally flat upper surface 73*b* which engages the shank portion 45*e* of the stationary shearing member 45. Thus as the cam 70 is rotated, the cam followers 73 are displaced simultaneously to the same position, thus raising or lowering the trimmer 35 in a uniform manner. To retain the cam followers assembled to the chassis 30 on removal of the head frame 32, the lower ends of cam followers 73 are formed with laterally extending stops 73*c* (FIG. 14) which engage the underside of chassis 30 and prevent removal upwardly from the openings 30*j*.

Each of the stepped portions or segments 70*c* of the annular portion 70*b* provides three distinct positions for the cam followers 73 to assume. In the position shown in FIG. 11, the cam followers are in their lowermost positions wherein the trimmer 35 is somewhat recessed with respect to the tops of the perforated combs 33 and 34. When the cam 70 is rotated to the position shown in FIG. 12, the cam followers 73 and the trimmer 35 are elevated to their maximum degree on a step 70*h* wherein the trimmer is well-spaced from the perforated combs 33 and 34 so that it may be used for trimming sideburns, moustaches and the like. It will be noted that between the minimum height position shown by FIG. 11 and the maximum height position shown by FIG. 12, there is shown a step 70*d* on the annular portion 70*b* of the cam 70 which represents an intermediate position suitable for shaving when it is desired to have maximum long hair pickup during the shaving operation. At the other end of each of the segments 70*c*, there is a projection or elevated step 70*e* which tends to raise the trimmer 35 to an elevated position. As will be shown in greater detail below, the step 70*e* is utilized in connection with removing the head assembly 21 in such a way that the trimmer biasing springs 48 and 49 aid in elevating the head frame 32 from its seated position on the chassis 30.

The control of the position of the cam 70 is accomplished by means of a trimmer control slide 75 which is mounted in a channel-shaped slot 24*e* formed in the front of the housing frame member 24 as is best shown in FIGS. 1 and 2. The slide 75 is elongated in the direction of the slot 24*e* and has lengthwise extending legs 75*a* and 75*b* as well as an outwardly extending control knob 75*c*. The housing frame member 24 is formed with a slot 24*f* which extends through the side wall thereof as is best shown in FIG. 8. The slide 75 is formed with a bifurcated projection 75*d* which extends through the slot 24*f* into the interior of the housing 22 as shown in FIGS. 2, 8 and 9. Extending through one of the bifurcated projections 75*d* is a short rod 76 which cooperates with notches 24*g* formed on the inner wall of the housing frame member 24 as shown in FIGS. 8 and 9. The rod 76 is biased into the notches 24*g* by the resilience of the arms 75*a* and 75*b* which are somewhat bowed in their normal position. Through further deflection of the arms 75*a* and 75*b* as a consequence of pressure on the knob 75*c*, the rod 76 may be displaced from any particular notch 24*g* whereby the slide 75 may be moved to any desired position.

The bifurcated projection 75*d* of the slide 75 straddles a post 77 which is integrally formed with the cam 70 as is best shown in FIG. 2. Thus upon movement of the slide 75 the cam 70 is rotated about its axis. To correlate the position of the slide 75 with the cam positions described in connection with FIGS. 11 and 12, there are provided suitable indicia on the housing 22 and the slide 75 as shown in FIG. 1. The position indicated by "1" in FIG. 1 is that shown in FIG. 11 while the trim position indicated by the circle to the right of the "2" is the position shown in FIG. 12. Thus the slide 75 provides a readily accessible and easily operable control to position the trimmer 35 in any one of a number of desired positions.

Figure 10:
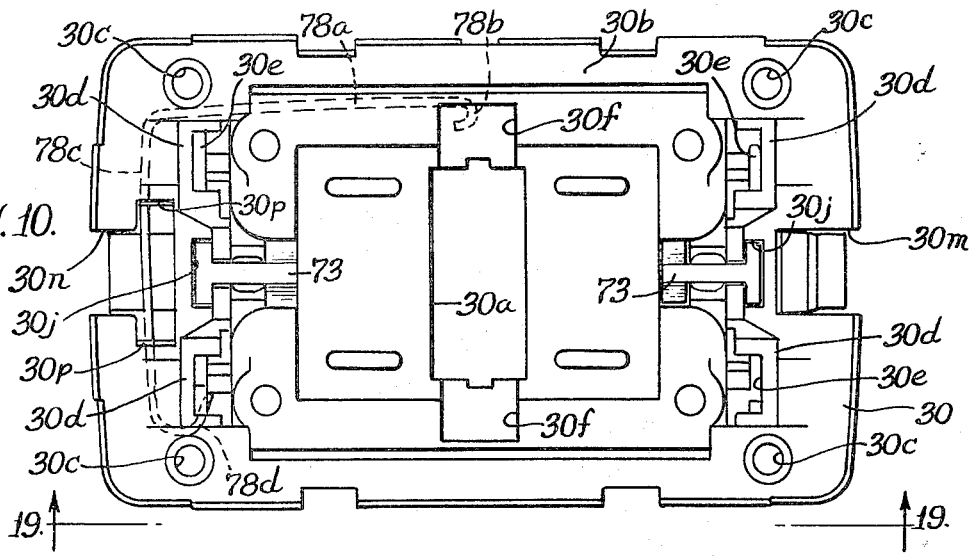
FIG. 10 is a top plan view of the shaver head chassis with the shaver cutters removed therefrom.

Brief reference was made above to the manner in which the cam 70 cooperated in removing the head frame 32. As is shown in FIGS. 4 and 5, the head frame 32 is formed with downwardly extending inwardly facing hooks 32*f* which retain the head frame 32 in mounted position on the chassis 30. The chassis 30 is formed with oppositely disposed pockets 30*m* and 30*n* as best illustrated by FIG. 10. The pocket 30*mm* is formed with an outwardly projecting shelf or wall 30*p* which is adapted to engage the hook 32*f* as illustrated in FIG. 4.

In the opposite pocket 30n in the chassis 30 there is positioned a latch spring 78 which engages the hook 32*f* which is received in the pocket 30*n*. The latch spring 78 is of generally L-shaped configuration and lies against the bottom of the plate-like portion 30*b* of the chassis 30 and is best shown mainly in dotted lines in FIG. 10. As is evident from FIG. 10, the spring 78 has a leg 78*a* which extends lengthwise along one edge of the chassis 30 to a centrally disposed end 78*b* which is bent in a somewhat hook-shaped configuration. The L-shaped latch spring 78 has a second leg 78*c* which extends transversely of the chassis 30 and is exposed in the pocket 30*n* at approximately its midpoint. The leg 78*c* is formed at its free end with a reversely bent portion 78*d* which encircles an integraally molded projection on the bottom of the chassis 30. The spring 78 is retained in position by virtue of the fact that the leg 78*c* extends through spaced openings 30*p* formed in the walls of the pocket 30*n* while the hook-shaped end 78*b* is trapped beneath the cam 70.

The end 78*b* of the latch spring 78 is positioned in a notched portion 70*f* of the cam 70 and is trapped between the cam and the bottom of the chassis 30. The notched portion 70*f* of the cam 70 is best shown in FIGS. 11 and 23. When the trimmer control slide 75 is pushed to the left as shown in FIG. 1 to the limit of its possible movement, the cam 70 is rotated in a clockwise direction as viewed from above causing a shoulder 70*g* positioned at the end of the notch 70 to engage the hook 78b thereby moving the spring leg 78*c* to the right as viewed in FIG. 10. This movement causes the spring 78 to be disengaged from the adjacent hook 32*f* thus releasing one end of the head assembly permitting the head frame 32 to shift slightly to the side so that the other hook 32*f* disengages from the wall 30*p* in the pocket 30*n*.

As was mentioned briefly above, the cam 70 includes steps 70*e* on which the followers 73 are supported when the cam 70 is rotated to the limit to its possible movement as when the control slide 75 is moved to the left as viewed in FIG. 1. Thus at the time the head frame hooks 32*f* are disengaged from the spring 78 and the wall 30*p*, the cam followers 73 have raised the trimmer 35 thus deflecting or tensioning the springs 48 and 49 which tend to bias the trimmer 35 to its lowermost position. Accordingly, with the springs 48 and 49 being carried by the head frame 32 and tensioned in this manner, they tend to cause the springs 48 and 49 to bias the head frame 32 out of engagement with the chassis 30. This provides the significant advantage in that the operator knows immediately that he has effected release or detachment of the head frame since the head frame 32 snaps away from the chassis 30 by virtue of the action of springs 48 and 49 at the time of release by the spring 78.

Turning now to the lower portion of the shaver 20, we note that the motor 26 is positioned so that its axis is generally coincident with the axis of the gripping portion 27 of the shaver housing 22. The motor 26 is retained in position by means of a simple U-shaped bracket 80 which is secured at either end by screws 81 which are threadedly received in posts 82 formed integrally with the housing frame member 24. In the preferred embodiment disclosed herein the motor 21 is a permanent magnet motor formed with a cup-shaped housing 83 which supports at its upper end an armature bearing 84 and at its lower end a plastic end bell 85. The end bell 85 is secured in position in the mouth of the cup-shaped housing by a pair of lengthwise extending C-shaped clamping members 86 which merely snap into retaining engagement with the end bell 85 and the cup-shaped housing 83. The end bell 86 has integrally formed posts which support helical springs 87 which bias brushes 88 into engagement with a commutator carried by an armature shaft 89. The lower armature bearing is also supported in the plastic end bell 85. Positioned below the motor 26 in the lower end of the gripping portion 27 are circuit components including a full wave rectifier 90, a capacitor 91 and a resistor 92 which are connected in circuit with motor 26 in a manner well known in the art.

The lower end of the housing 22 is formed with an opening 93 within which suitable terminal pins 94 are supported by means of an insulating fibreboard partition 95. The fibreboard portion 95 also supports a suitable single pole switch 96 which includes a slide operating button 97 which projects outwardly through an opening 98 formed in the front wall of the housing 22. By having the terminal pins 94 located at the lower end of the gripping portion 27 of the housing 22, the power cord used to connect the motor to a suitable power source is located in a manner so that it does not interfere with the head assembly during the normal usage of the shaver 20. Similarly, the switch 96 and its associated control button 97 is positioned below the area in which the housing 22 is normally gripped but is still conveniently located for easy operation.

The rear housing member 25 is formed with a plurality of bosses 99 which are positioned and adapted to engage posts 100 which extend from the frame member 24 into engagement with recesses 102 formed in the bosses 99. Suitable assembly screws 103 extend through the rear housing member 25 into threaded engagement with the posts 100 to secure the rear housing member in assembled relation to the front housing or frame member 24. The screws 103 are recessed as shown in FIG. 2 so that they do not interfere with the gripping of the portion 27 of the housing 22. As may be appreciated from the above description, the frame member 24 serves to support directly the motor 26 and indirectly the head assembly 21 and the drive levers 37 and 38. By having the single plastic molded member 24 serving as a frame to support and locate the motor, head assembly and drive levers, a simple and accurate assembly of the major functional parts of the shaver is assured. The head supporting chassis 30 is accurately located in the opening in the frame member 24 defined between walls 24*a*, 24*b* and 24*c*. The rear housing member 25 simply serves as a cover to complete the housing 22 and provides a means for obtaining easy access to the motor 26 for service purposes.

The head assembly 21 represents a significant advance in the art in that it provides in compact relationship two close shaving heads and a long hair clipper which may be moved from a position for use in shaving to a position spaced from the shaving heads in which it is adapted to clip or trim sideburns, moustaches, beards and the like. The relationship between the level of the shaving heads and trimmer 35 is accurately controlled by virtue of the mounting of the cutters 36 on the head supporting chassis 30 and the locating of the trimmer 35 by means of the cam 70 which is also supported on the chassis 30. Excellent engagement between the perforated combs 33 and 34 and the cutters 36 is assured as a consequence of the manner in which the perforated combs are mounted in the head frame 32.

This mounting includes the pivotal connection of the combs at one edge by means of the strips 40 which are pivoted at their ends to the head frame 32. The other edges of the combs 33 and 34 are secured to the spring biased plates 33 which draw the perforated combs into intimate shearing engagement with the cutters 36. It should also be noted that this mounting engagement permits the combs 33 and 34 to extend beneath the teeth on the trimmer 35 so that a more or less continuous shaving surface is presented to the face of the user. Thus the substantial areas of the perforated combs 33 and 34 are separated only by the trimmer 35 which is closely associated with both of the combs. As the shaver is moved across the face, the perforated combs tend to pick up and cut closely any facial hair which may be accumulated in the comb openings. If some of the facial hair is of such a length that it bends over from the upright position and lies against the face thereby not entering the comb perforations, the teeth on the trimmer 35 tend to pick up the longer hair and trim it so that it may then be more readily cut even shorter by the shaving heads.

Because of the fact that some men's skin is more tender than others, the trimmer 35 is provided with several alternative positions for shaving. In the No. 2 position in which the cam followers 73 are engaged with the step 70*d* on the cam 70, the trimmer 35 is essentially at the same height as the tops of the combs 33 and 34. Most men will find this position satisfactory since the trimmer 35 will be continuously engaged with the skin to pick up any long hairs. Men with more sensitive skin, however, will prefer to use the shaver 20 with the trimmer 35 retracted or No. 1 position in which the trimmer is displaced slightly below the level of the tops of the combs 33 and 34. With the trimmer in the No. 1 position, the degree of engagement between the face and the trimmer 35 is determined primarily by the amount of force utilized by the user as he passes the shaver across his face. The user with a particularly tender face will tend to press lightly keeping the trimmer 35 somewhat spaced from the skin thus avoiding any possible irritation.

As a consequence of the movability of the trimmer 35 whereby it may be elevated to the position shown in FIG. 12, the shaver 20 has the advantage that the trimmer, which is in effective position during the shaving operation, may be moved to a point spaced from the shaving heads in order to accomplish the trimmer of sideburns, moustaches, beards and the like. This permits the same trimmer to perform the functions which are usually only possible when substituting a separate clipper for a conventional shaving head. In the shaver of the instant invention, it is only necessary to actuate the slide 75 to adapt the shaver to the clipping or trimming of sideburns, moustaches, beards and the like.

While there has been shown and described a particular embodiment of the present invention, it will be apparent to those skilled in the art that various changes and modifications may be made without departing from the invention in its broader aspects, and it is, therefore, contemplated in the appended claims to cover all such changes and modifications as fall within the true spirit and scope of the present invention.

What is claimed as new and desired to be secured by Letters Patent of the United States is:

1. An electric shaver having means for cutting long and short facial hair and for trimming moustaches and sideburns comprising a pair of arched perforated shaving combs supported in spaced parallel relation on a supporting frame, a housing enclosing a motor, oscillating driving means connected to said motor and extending outside of said housing, a pair of separated cutting means each driven by said driving means and each engaged with the underside of one of said combs to cut hair therebetween, a T-shaped trimmer having mounting and driving portions extending between said combs and said cutting means toward said housing, said trimmer having support means which guide said trimmer for movement in the direction in which said mounting portion extends to position said trimmer in at least two alternative positions, said trimmer having oppositely facing rows of cutting teeth which overlie the edges of said combs, one of said positions being a position in which said teeth lie in a plane tangent to the curvature of said combs, the other of said positions being a second position in which said trimmer is elevated above said combs to permit trimming of hair independent of the use of said shaving combs, said housing enclosing a rotary cam which is actuable from the exterior of said housing to position said trimmer in either of said positions, cam followers extending from said cam through the wall of said housing into engagement with the mounting portions of said trimmer, a manually operated slide on said housing for actuating said cam, said slide comprising a one piece plastic member having a pair of outwardly extending flexible arms which engage the outside wall of said housing and a connecting portion extending through a slot in said housing into engagement with said cam, combination retaining and detent means in said connecting portion biased into engagement with the interior of said housing by said arms.

2. An electric shaver having means for cutting long and short facial hair and for trimming moustaches and sideburns comprising a pair of arched perforated shaving combs supported in spaced parallel relation on a supportimg frame, a housing enclosing a motor, oscillating driving means connected to said motor and extending outside of said housing, a pair of separated cutting means each driven by said driving means and each engaged with the underside of one of said combs to cut hair therebetween, a T-shaped trimmer having mounting and driving portions extending between said combs and said cutting means toward said housing, said trimmer having support means which guide said trimmer for movement in the direction in which said mounting portion extends to position said trimmer in at least two alternative positions, said trimmer having oppositely facing rows of cutting teeth which overlie the edges of said combs, one of said positions being a position in which said teeth lie in a plane tangent to the curvature of said combs, the other of said positions being a second position in which said trimmer is elevated above said combs to permit trimming of hair independent of the use of said shaving combs, said driving means including a pair of eccentrics driven by said motor and a pair of crank levers pivoted on the housing with one being driven by each eccentric, each said lever extending through openings in said housing into engagement with said cutting means, means for supporting each said cutting means for reciprocation on said housing, said cutting means supporting means comprising a bearing race and a cutting means carrier, anti-friction bearings between said race and carrier to support said cutting means against downward forces exerted by said comb, and aligned and opposed springs engaging said race and opposite sides of said lever to store and release energy as said cutting means reciprocates.

3. An electric shaver comprising two spaced short hair shaving heads and a long hair trimmer supported in part on a head frame which is removably mounted on a housing, said housing enclosing a motor which drives the shaving heads and trimmer, said shaving heads include a pair of cutters mounted for reciprocating movement on said housing within said head frame, said shaving heads also including perforated flexible combs mounted on said head frame, guide means on said head frame supporting said trimmer for movement toward and away from said shaving heads, cam means on said housing to control the position of said trimmer, and means on said head frame biasing said movable trimmer into engagement with said cam means.

4. The shaver of claim 3 wherein said cam means comprises a cylindrical cam rotatable about an axis parallel with the direction of movement of said trimmer, a pair of stepped annular cam surfaces on said cam, cam followers acting between said surfaces and said trimmer to raise and lower the opposite ends of said trimmer simultaneously.

5. The shaver of claim 4 wherein said cam surface has steps to locate said trimmer in three different positions upon rotation of said cam, latch means for said head frame to detachably mount said frame on said housing, means connecting said cam and said latch whereby rotation of said cam releases said latch to remove said head frame for cleaning purposes.

6. The shaver of claim 3 including mounting means for supporting said cutters on said housing for reciprocation thereon, said mounting means including bearing balls mounted beneath said cutters to absorb the thrust applied thereto.

7. The shaver of claim 3 including means for supporting said cutters on said housing, drive means interconnecting said motor and said cutters, spring means acting between said drive means and said housing to absorb energy as said cutters and drive means approach the limit of movement prior to reversing direction and to release energy after said cutters and drive means have reversed direction.

8. The electric shaver of claim 3 including releasable latch means for detachably retaining said head frame with respect to said housing, said means on said head frame biasing said movable trimmer acting in a direction to urge said head frame out of engagement with said housing when said latch means is released.

9. The electric shaver of claim 3 including anti-friction bearings between said cutters and said housing, spring means on said head frame drawing said combs into shearing engagement with said cutters, said bearings receiving the load delivered by said spring means.

10. An electric shaver comprising a housing enclosing an electric motor, a head frame removably mounted on said housing, said housing and head frame supporting two shaving heads and a long hair trimmer which extends between said shaving heads, said trimmer having a T-shaped stationary shearing member and a reciprocating shearing member, both of said shearing members have oppositely facing rows of teeth which are biased into shearing engagement by first spring means, said shaving heads each including a flexible perforated plate, one edge of said plate being pivotally connected to said head frame at each end beneath said trimmer, a movable frame supporting the other edge of each said plate with respect to said head frame, second spring means biasing said movable frame toward said cutters.

11. The electric shaver of claim 10 including cam means on said housing for adjustably positioning said trimmer with respect to said head frame, third spring means on said head frame biasing said stationary shearing member into engagement with said cam means.

12. An electric shaver comprising a housing enclosing and electric motor, a head frame removably mounted on said housing, said housing and head frame supporting two shaving heads and a long hair trimmer which extends between said shaving heads, said trimmer having a T-shaped stationary shearing member and a reciprocating shearing member, both of said shearing members have oppositely facing rows of teeth which are biased into shearing engagement by first spring means, said shaving heads each including a flexible perforated plate, one edge of said plate being pivotally connected to said head frame at each end beneath said trimmer, a movable frame supporting the other edge of each said plate with respect to said head frame, second spring means biasing said movable frame toward said cutters, said head frame being formed with spaced parallel side walls which are interconnected by end walls to form an open frame, said end walls being formed with spaced channels which receive and guide said stationary shearing member, L-shaped torsion springs mounted on said side walls of said head frame each having a leg engaged at an opposite end of said stationary shearing member to bias said trimmer to a position adjacent said shaving heads, and cam means on said housing to urge said trimmer upwardly to a position spaced from said shaving heads for trimming sideburns and other long hair.

13. In an electric shaver of the type having a motor driving a plurality of reciprocating cutters which engage perforated combs supported on a detachable head frame, the improvement comprising a long hair trimmer mounted between said combs on said head frame, said trimmer having a cross section of T-shaped configuration and being formed by a flat comb plate which extends lengthwise of said head parallel to the direction of reciprocation of said cutters and a mounting shank which extends downwardly of said comb plate and perpendicular thereto, said comb plate having rows of teeth on the opposite edges overlying the inner edges of said perforated combs, means mounting said shank in order to adjustably position the height of said trimmer with respect to said perforated combs, said shank being of inverted U-shape with the bight portion secured to said plate and the legs thereof received in slots in said head frame, a cutter having two rows of teeth which are positioned to engage said comb teeth, said cutter being formed with an open channel which straddles said shank to guide said cutter in reciprocating movement against said comb.

14. The combination of claim 13 wherein said shank is formed with inwardly directed spring supports on the free ends of said legs, springs mounted on said supports engaging said cutter biasing said cutter into engagement with said comb plate.

15. The combination of claim 13 wherein said cutter comprises two identical stampings secured rigidly together, each stamping including one of said rows of teeth and forming half of said open channel, said stampings having spaced portions forming a pocket which is adapted to receive the drive mechanism for reciprocating said cutter.

16. An electric shaver comprising a housing supporting at least two shaving heads, each said head having a cutter mounted for reciprocation in engagement with a stationary shearing member, a motor having a rotating shaft, a pair of pivotally mounted levers drivingly interconnecting said shaft and said cutters to reciprocate said cutters in opposite directions, a crank member extending from said shaft and having two axially spaced eccentrics with one of said eccentrics engaged with the inner end of each of said levers, said levers being pivotal about a common axis and connected to said cutters, said common axis being coplanar but angled with respect to the axis of said rotating shaft, and said eccentrics being offset from the axis of said shaft in diametrically opposite directions so that said levers oscillate in an out of phase relation, one of said levers having its inner end formed with a bifurcated end in which a pivot yoke is mounted, said yoke being received on one of said eccentrics to oscillate said one lever as said shaft rotates, the other of said levers having its inner end formed with a semi-cylindrical yoke support which extends laterally from the end of said other lever, a second yoke pivotally mounted in said yoke support and positioned to engage the other of said eccentrics whereby said other lever is oscillated by said other eccentric.

17. The electric shaver of claim 16 wherein said levers extend through a common opening in said housing and are mounted on a common shaft, said common shaft being journaled in bearings which are received in recesses positioned in the outer surface of said housing adjacent said opening, a plate secured to said outer surface to retain said bearings in said recesses.

* * * * *